US005864077A

United States Patent [19]

Gatzen

[11] Patent Number: 5,864,077

[45] Date of Patent: Jan. 26, 1999

[54] DRUMHEAD

[75] Inventor: Robert A. Gatzen, Newington, Conn.

[73] Assignee: Innovative Automation, Inc., Farmingdale, N.Y.

[21] Appl. No.: 856,986

[22] Filed: May 15, 1997

[51] Int. Cl.[6] ..... G10D 13/02

[52] U.S. Cl. ..... 84/414; 84/411 M

[58] Field of Search ..... 84/414, 411 M

[56] References Cited

U.S. PATENT DOCUMENTS 2,934,989 5/1960 Belli et al. .
2,979,981 4/1961 Ludwig .
3,250,169 5/1966 Stone, Jr. et al. .
3,418,877 12/1968 Ito .
4,244,266 1/1981 Hardy .
4,254,685 3/1981 Rose ..... 84/414
4,779,508 10/1988 Beals .
4,805,514 2/1989 Billings .
5,159,139 10/1992 Beals et al. .

*Primary Examiner*—William M. Shoop, Jr.
*Assistant Examiner*—Shih-yung Hsieh
*Attorney, Agent, or Firm*—Hedman, Gibson & Costigan, P.C.

[57] ABSTRACT

A polymer film drumhead having indentations in the surface, the indentations placed strategically by size, number and placement near the periphery of the drumhead to control the vibrational characteristics and the overtone content of the drumhead when struck.

10 Claims, 10 Drawing Sheets

DRUMHEAD

FIELD OF THE INVENTION

This invention relates generally to drumheads for musical drums. More particularly, the invention relates to a technique of film surface manipulation to control the vibrational characteristics of the drumhead, hence, controlling the tone of the drum.

BACKGROUND OF THE INVENTION

Drumheads were long made of natural products, most preferably calf skin, stretched over a drum body opening. More recently, polymer films have been developed for forming drumheads where the polymer film is formed, cut to a specific size and attached to a hoop. The drumhead is then stretched over a drum body opening and tightened.

The drumhead generates sound when struck with a stick type device, hands, brushes, etc. The "attack"is the initial period of a generated tone. When the drumhead is struck a number of frequencies are excited and the nature of the attack characteristics, the clarity and crispness of the fundamental tones, are developed. Frequency control is the key element to shaping the attack characteristics.

Therefore, as well as being a tone generator, the drumhead must also act as a tone control. There are a number of existing techniques for controlling tone based upon the control of the rate of vibration and/or the suppression of overtones generated when struck. These techniques of drumhead "dampening" offer a means of reaching a desired feel and sound for each individual drummer's taste and discretion. Often, this technique relates to musical application.

Currently, the known techniques for dampening a drumhead include adding an additional element that is applied to the drumhead, i.e., a coating, vinyl applique or adhesive. An example of such an adhesive patch is seen in U.S. Pat. No. 4,244,266.

Another method currently used is a dampening or tone control ring, formed of a polymer film placed against the drumhead about the peripheral edge of the drumhead. This technique is shown in U.S. Pat. No. 5,159,139.

Each of these techniques, however, diminish the attack and the overall volume of the head. In most cases, the existing methods for dampening are drastic in effect and offer little or no variation in dampening control.

Moreover, although dampening techniques also effect the tuning of the drum, current methods of dampening limit the amount of usable and effective tuning areas. More often than not, the limitation is that effective tuning of the head is often limited to specific regions of pitch. This is because of the diminishing levels of attack and sustain as a result of other tuning sequences.

An important objective is to control the amount of overtone content without changing, i.e. dulling, the attack characteristics. This is particularly important because the primary sound that human beings relate to in musical listening is attack. In fact, it is considered to be an audio phenomena that the listener is tremendously effected by attack characteristics in tone generated by musical instruments. The attack period of a generated tone communicates the emotion and the rhythmic scheme of a musical performance.

It is therefore an object of the invention to provide a polymer film drumhead which includes dampening means to improve tone control.

It is a further object to provide a drumhead with dampening means that is easy to produce.

Another objective is to offer the drummer many variations in tone that will render an appropriate drum sound to fit the musical application. For instance, an open ringy sound versus a dull, thuddy, pulsating tone.

Yet another objective is to offer variations in the way the head "feels" to the drummer, i.e., making the striking of the head either feel lively and springy or stiff and boardy in nature. These are choices in sound and feel are totally objective, nevertheless important in terms of providing a comfortable performance environment for the drummer.

SUMMARY OF THE INVENTION

These and other objects are achieved by the present invention which comprises a polymer film drumhead having a plurality of preformed indentations on a surface of the drumhead.

The technique involves a series of indentations on the drumhead. The indentations are preferably located towards the perimeter of the drumhead surface area since that is the area of the head which often produces "unwanted" overtones. The number and proximity of indentations need not be excessive since overtones do not need to be totally dampened, playing an important role in producing attack and volume.

The indentations may vary in shape, frequency and placement to provided various qualities of sound. In this regard, the shape, the size and the depth of the indentations, may be varied. The shape, size and depth will also, in part, provide direction as to the number and placement of the indentations for different tonal characteristics.

For instance, random placement of indentations will diffuse the pitched characteristic in the tone of the head, while a more organized and consistent pattern of denting will allow more evenness in tone. Of course, the amount of indenting will affect the resonance or duration of the head.

Due to the number of variations, the invention of the present application may be used to provide infinite increments in controlling the tone produced by drumhead vibration.

This technique may be applied to all types of drumhead configurations, including single, two ply, coated and non-coated surfaced drumheads, as well as to all size drumheads.

Similarly, in drumheads having a dampening polymer film tone control ring about the circumferential edge, as shown in U.S. Pat. No. 5,159,139, the indentations can be on a surface of the ring.

Formation of the indentations can be achieved by any known means. Most preferred, however, are mating embossing dies which are pressed together without the use of heat.

The pre-denting technique will offer many variations in the level of dampening, allowing for more versatility in tuning and head life.

DETAILED DESCRIPTION OF THE PREFERRED EMBODIMENT

Figure 1:
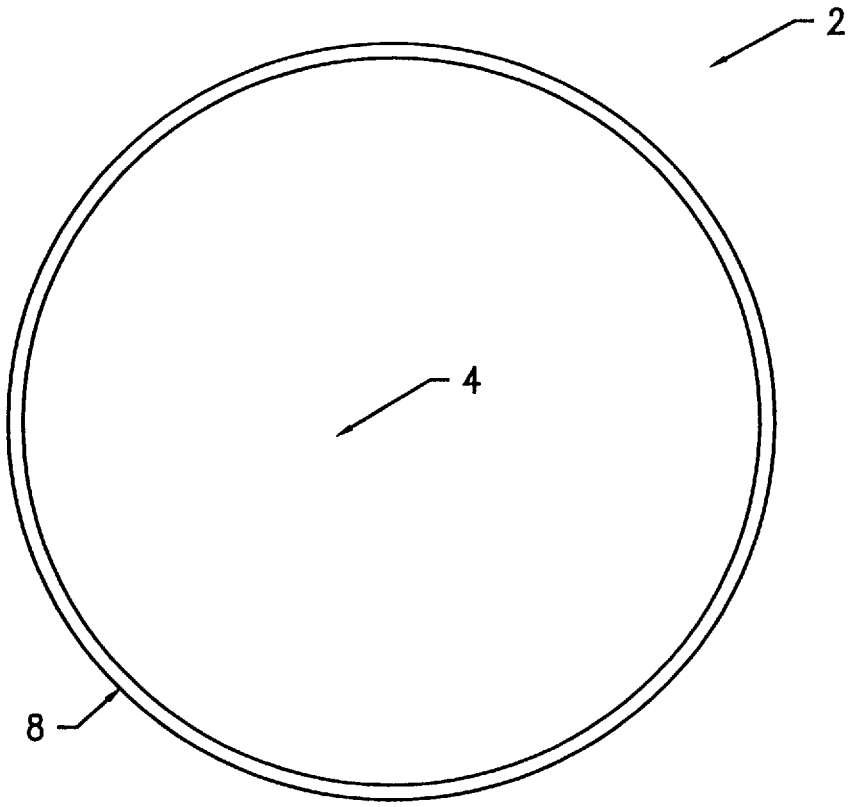
(PRIOR ART) FIG. 1
FIG. 1 is a plan view of a polymer film drumhead of the prior art.
Figure 2:
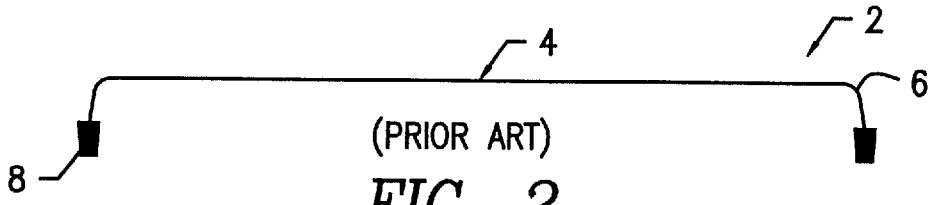
(PRIOR ART) FIG. 2
FIG. 2 is a cross-sectional elevation of a polymer film drumhead of the prior art.

The present invention is directed to drumheads 2 produced of synthetic materials such as polymer film, having generally flat surfaces on the top and bottom. The primary synthetic film material currently in use for drumheads is polyester, however, laminates and other suitable polymer materials are contemplated herein. Generally, the film thickness of the preferred polyester material is from about 0.007 to about 0.010 inch, of which sometimes a double layer is used.

As shown in the drawing FIGS., the polymer film is formed into a drumhead including a generally flat circular center portion 4 of the drumhead, which is stretched across a drum body (not shown), and a peripheral flange 6 provided with flutes to accommodate the change in direction of the polymer film at the circumference. The free edge of the flange can be secured to a hoop 8 at its edges by a variety of known means including mechanical fasteners and, most preferably, a resin as described in U.S. Pat. No. 4,779,508.

Figure 3:
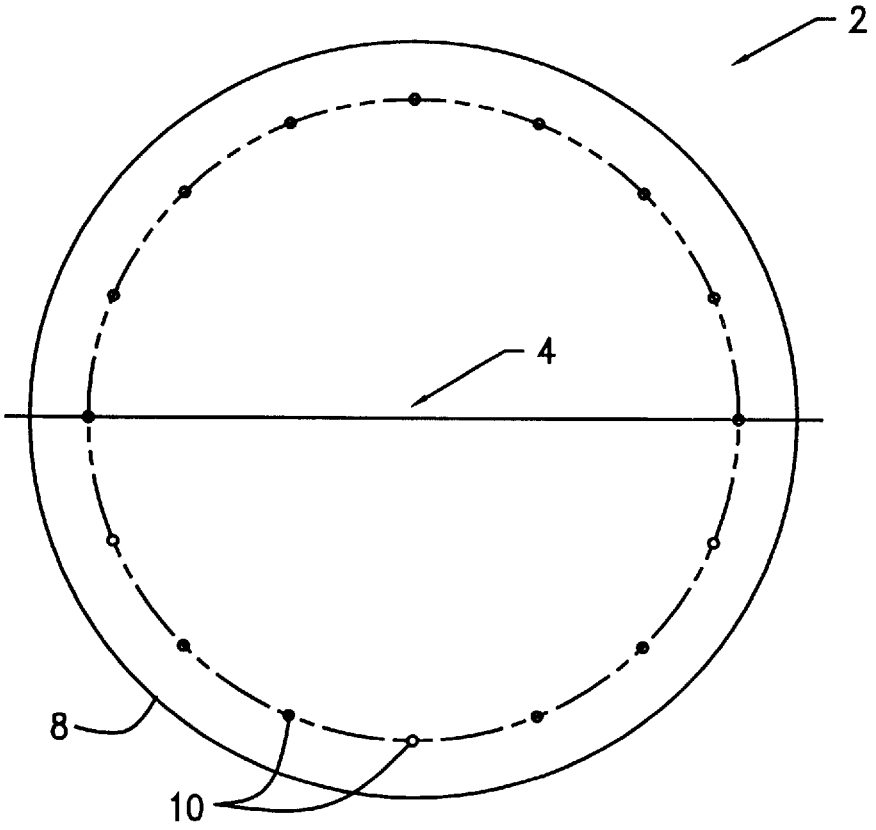
FIG. 3 is a plan view of a polymer film drumhead utilizing one embodiment of the present invention.
Figure 4:
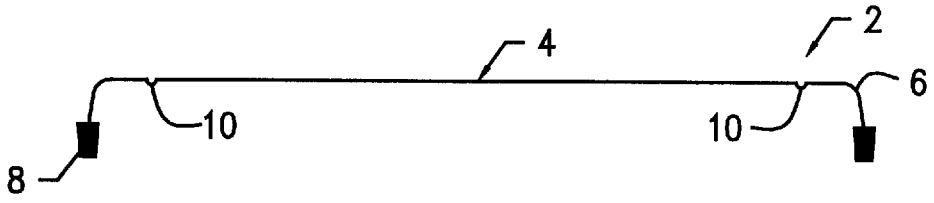
FIG. 4 is a cross-sectional elevation of a polymer film drumhead of the present invention of FIG. 3.

In accordance with one embodiment of the present invention, shown in FIGS. 3 and 4, indentations 10 are placed in a circular arrangement at the periphery of the center portion 4 of the drumhead 2. FIGS. 3 and 4 show a sample pattern of indentations 10 for a fourteen inch (14") drumhead, however, it is understood that the indentations 10 can be used on any size drumhead. Of course, the number, size and pattern of indentations may be varied to achieve a desired sound or when other drumhead sizes are being manufactured.

The shape of the indentations 10 can be circular (as shown in the drawings for illustration), oval, oblong, square, rectangular, etc., can be of uniform or varying depth and can be spaced close together or farther apart. The intended limitations on the indentations 10 are only that the shape, size, depth, number and placement are helpful in dampening overtones to achieve a desired sound. Preferred, however, are circular indentations of from about 1/16 to about 1/4 inches in diameter and having a depth of from about 1/32 to about 1/8 inches.

Figure 16:
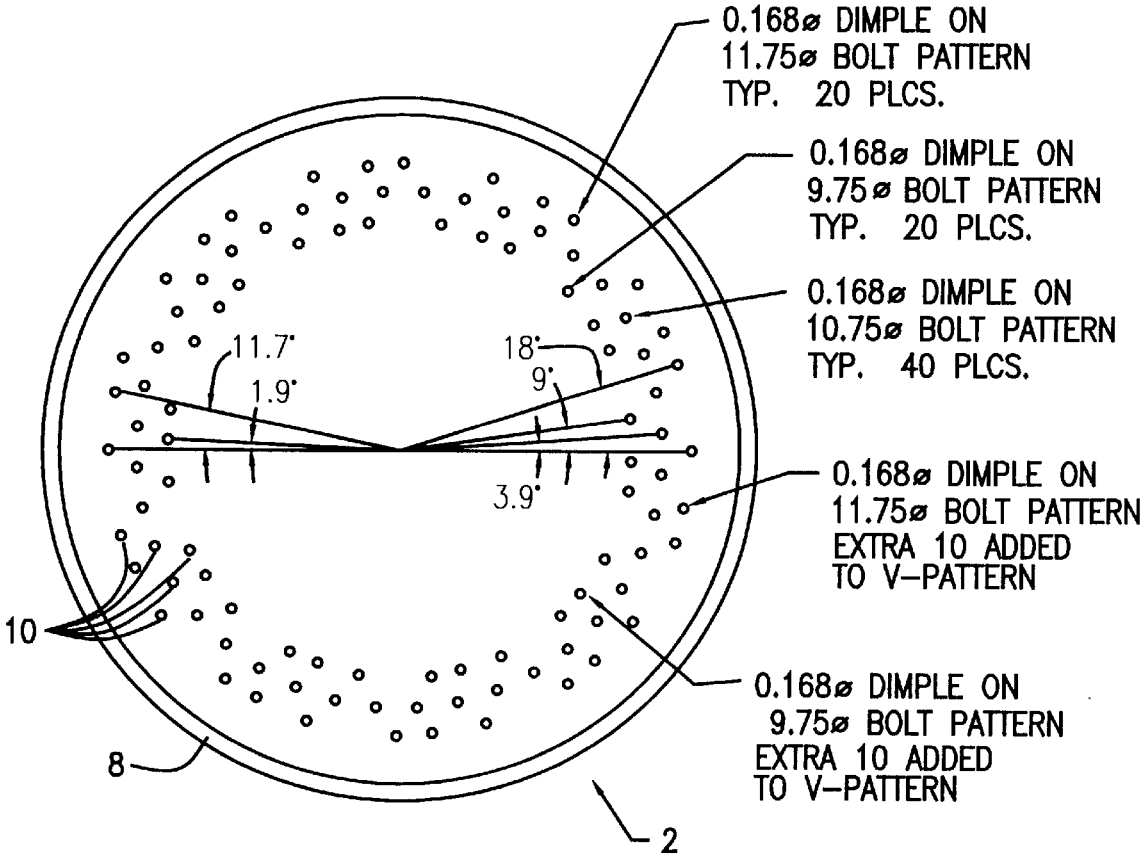

In a preferred embodiment on a 14" drumhead 2, shown in FIGS. 3 and 4, 16 circular indentations 10 of about 0.160 inches in diameter and about 0.072 inches deep are symmetrically sequenced about a circumference located from about 3/4 inch to about one inch from the edge of the drumhead 2. This arrangement has been found to provide effective dampening and improved tonal quality.

Figure 5:
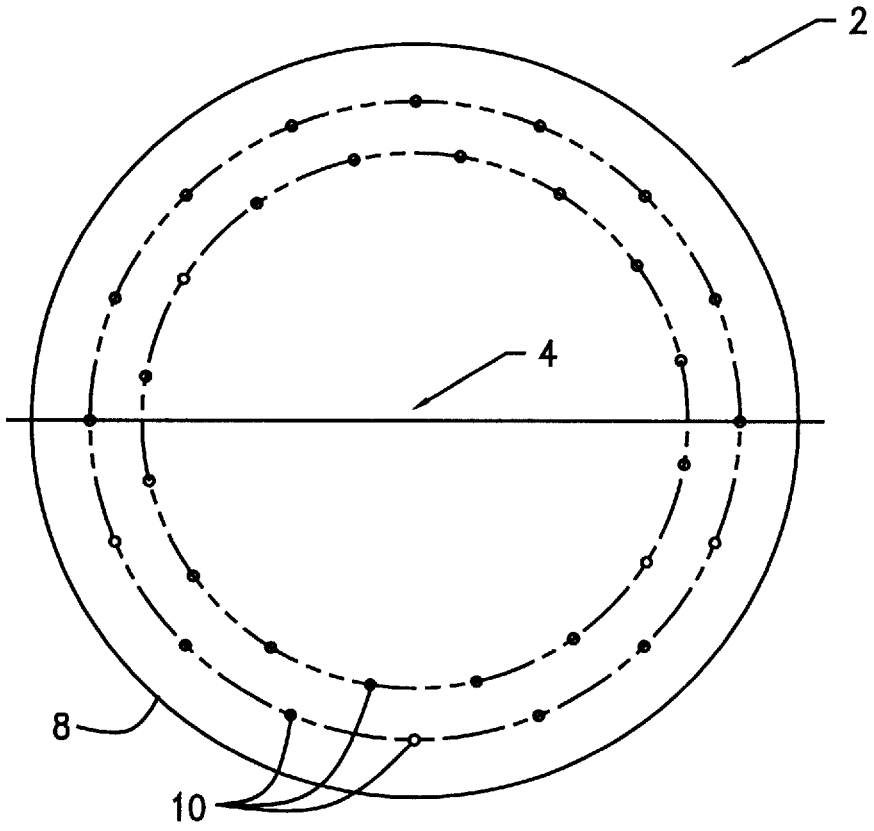
FIG. 5 is a plan view of a polymer film drumhead utilizing an alternative embodiment of the present invention.
Figure 6:
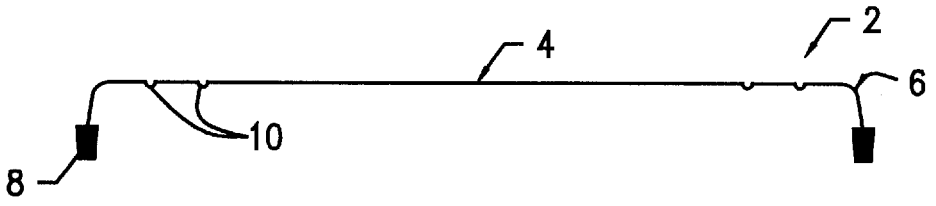
FIG. 6 is a cross-sectional elevation of a polymer film drumhead of the present invention having the alternative indentation design of FIG. 5.
Figure 7:
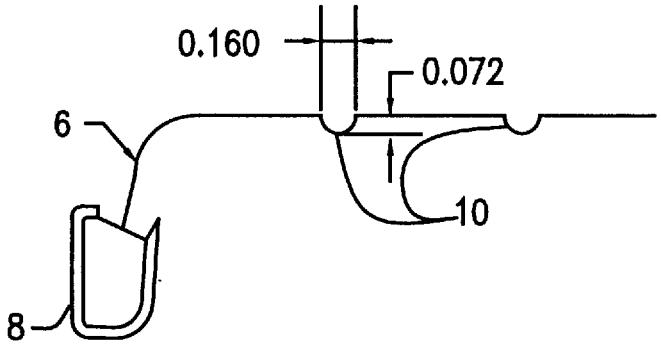
FIG. 7 is a partial cross-sectional elevation of a polymer film drumhead of the present invention of FIG. 5.

In another preferred embodiment for a 14" drumhead 2, shown in FIGS. 5, 6 and 7, two tiers of indentations 10 are used, each tier having 16 indentations 10 of about 0.16 inch in diameter and about 0.72 inch deep. The first tier comprises indentations 10 symmetrically sequenced about a circumference located about 3/4 inch to about one inch from the peripheral edge of the drumhead 2 and the second tier is located about 1 1/2 inches to about two inches from the peripheral edge of the drumhead 2.

Additional symmetrical patterns of 3, 4, 5 or 6 indentations grouped with a space between groupings has been found to be very effective.

Figure 10:
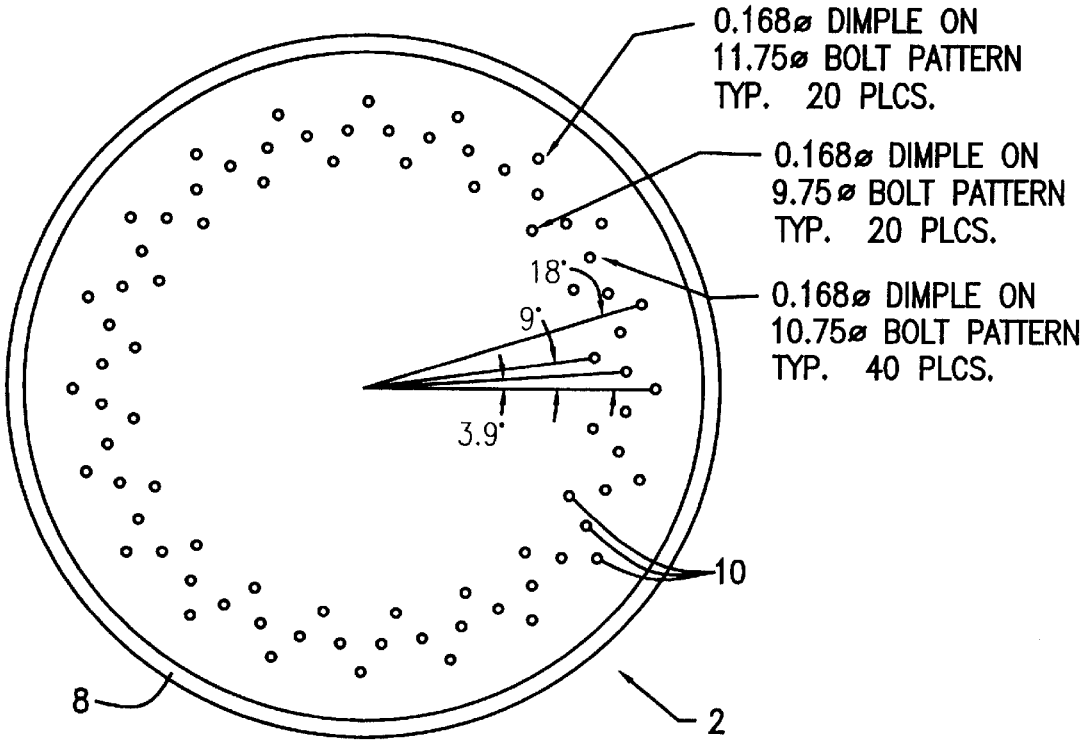
FIGS. 10–19 are alternating plan and cross-sectional elevational views of various preferred pattern designs of the drumhead of the present invention.
Figure 11:
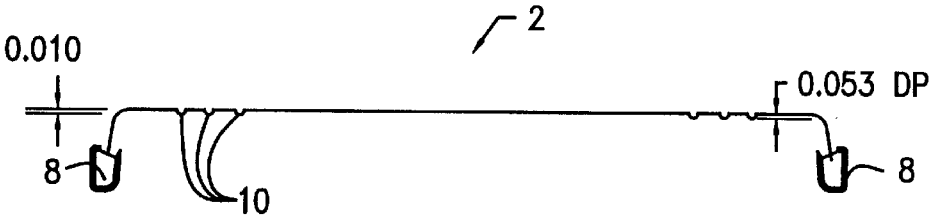

FIGS. 10 and 11 show a most preferred embodiment on a 14 inch drumhead wherein the preformed indentations 10 are placed in "V" pattern about the peripheral portion of the drumhead 2. In this embodiment the indentations are about 0.168" in diameter and about 0.053" in depth on a 0.010" thick MYLAR sheet. The inner indentations are about 9.75" from the drumhead center, the middle indentations 10 are about 10.75" from the drumhead center and the outer indentations 10 are about 11.75" from the drumhead center.

Figure 12:
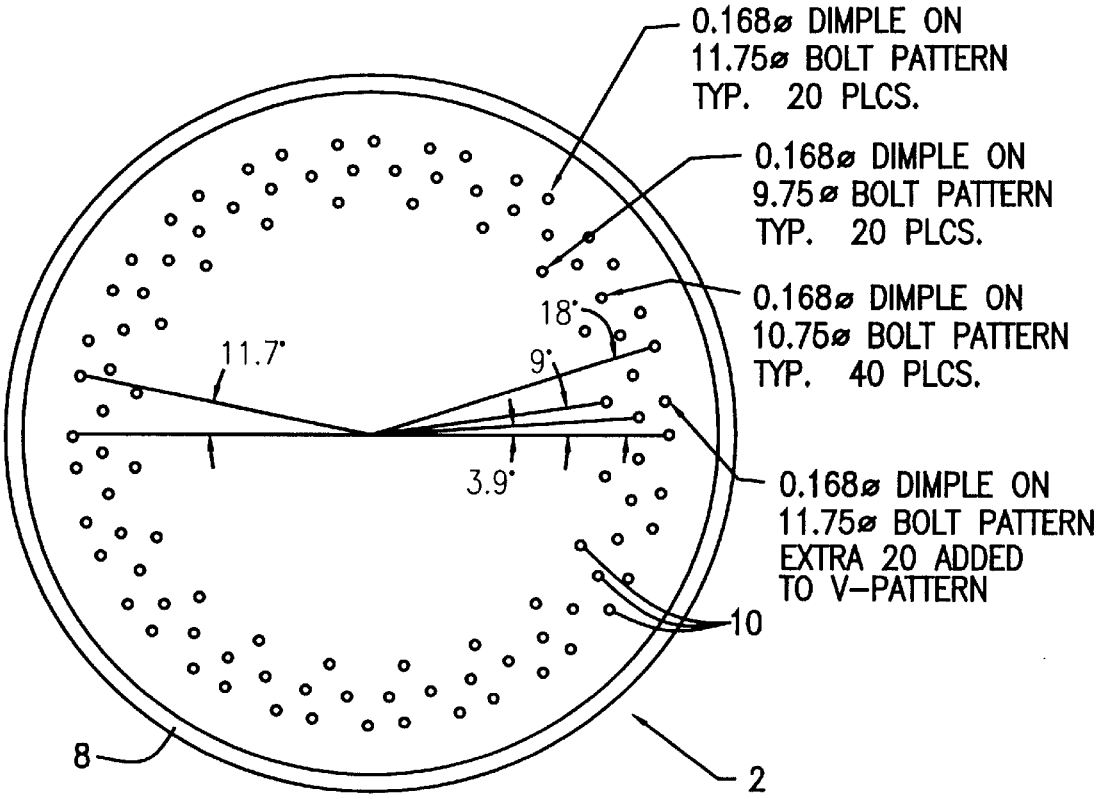
Figure 13:
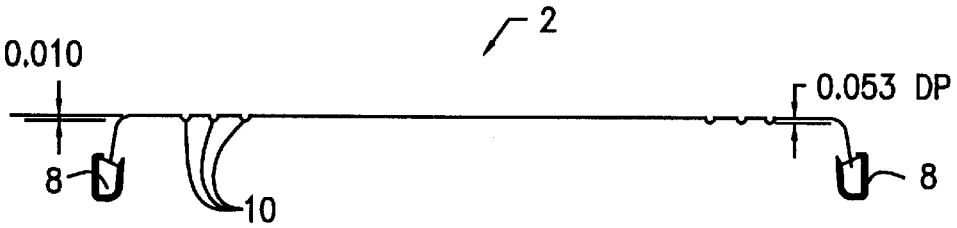

FIGS. 12 and 13 show a most preferred embodiment similar to that of FIGS. 10 and 11, having an additional preformed indentation within the "V" pattern adjacent to one side of an outer indentation 10.

Figure 14:
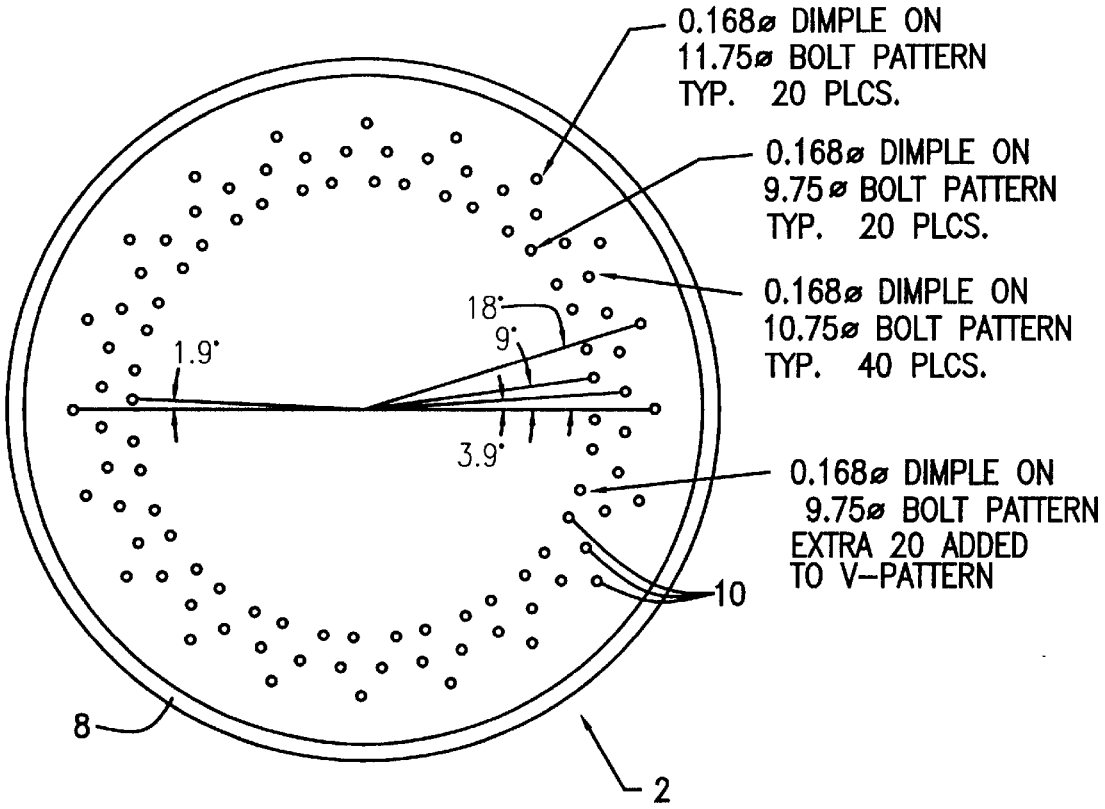
Figure 15:
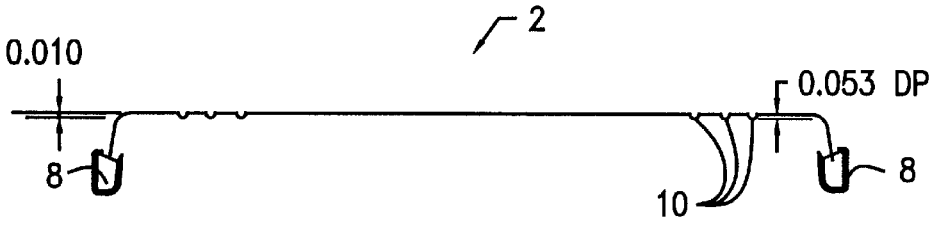

FIGS. 14 and 15 show a most preferred embodiment similar to that of FIGS. 10 and 11 but with an additional indentation 10 within the "V" pattern adjacent the inner indentations 10.

Figure 17:
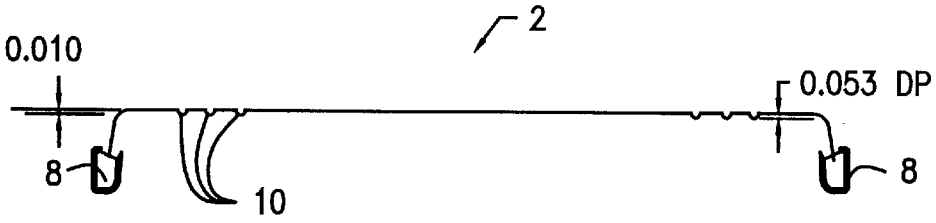

FIGS. 16 and 17 illustrate another most preferred embodiment similar to FIGS. 10 and 11 but with two additional indentations 10 within the "V" pattern, one at the inner indentations 10 and one at the outer indentations 10.

Figure 18:
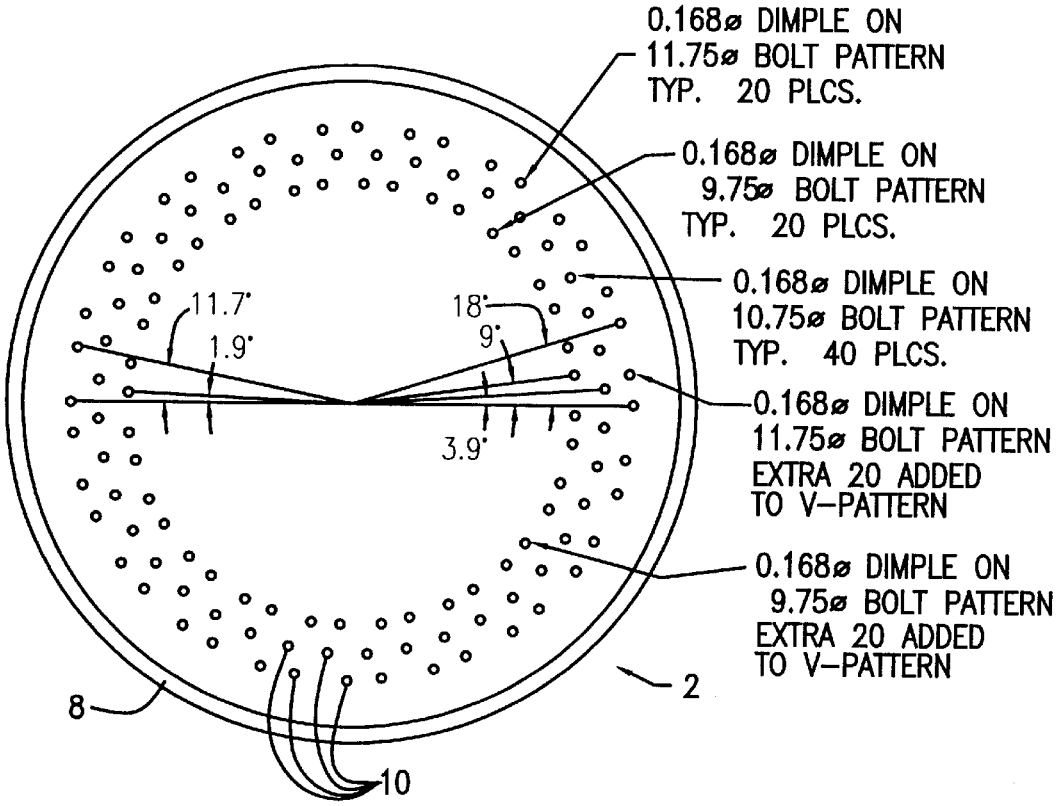
Figure 19:
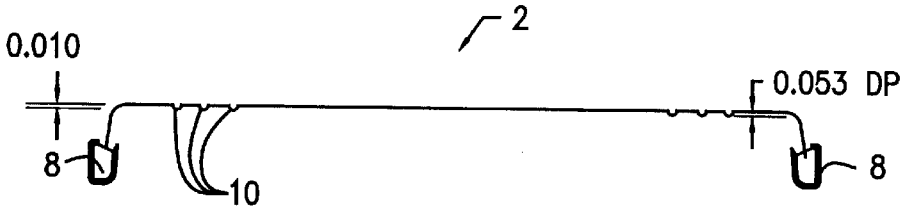

Finally, FIGS. 18 and 19 illustrate a further preferred embodiment similar to FIGS. 10 and 11 but with two additional indentations 10 within each "V" pattern at the inner indentation and one additional indentation 10 at the outer indentations 10.

Of course, other patterns are also contemplated to fall within the scope of the present invention as are different size or shape indentations within a pattern. Moreover, it is expected that different patterns will be more effective with different sized drumheads. What has generally been found, however, is that where an organized and consistent pattern of indentations 10 will provide a more even tone, a more random pattern of indentations 10 will diffuse the pitched characteristic in the tone of the drumhead 2. In any event, as stated above, the indentations 10 are preferably placed about the periphery of the center portion 4 of the drumhead 2.

Additionally, it is preferred that the excessive frequency of indentations be avoided wherein overtones need not be totally dampened, since overtones do play an important role in producing attack and volume. The present invention provides infinite increments for one skilled in the art to control the tone produced by drumhead vibration. As such, the amount of overtone can be controlled without dulling the attack characteristics.

Figure 8:
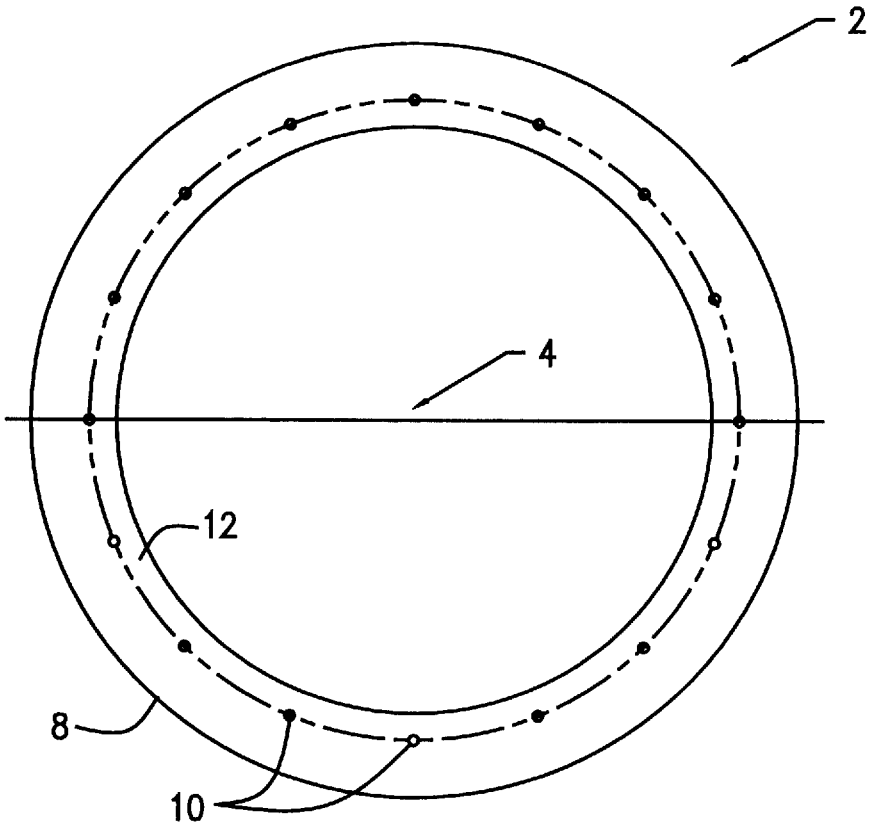
FIG. 8 is a plan view of a polymer film drumhead having a polymer film ring about the circumferential edge forming the drumhead, the present invention being incorporated within the polymer film ring.
Figure 9:
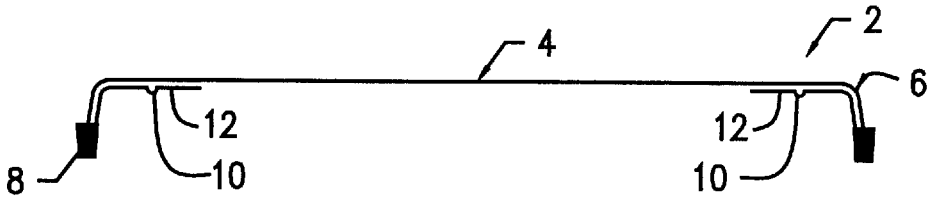
FIG. 9 is a cross-sectional elevation of the drumhead of the present invention of FIG. 8.

The present invention can also be used when a drumhead 2 is formed of layers of the polymer film or when a tone control ring 12 is used (see FIGS. 8 and 9). Although FIG. 9 shows the indentations 10 in the tone control ring 12, it is understood that the indentation can be in the drumhead 2 layer as well as the ring 12.

It is also understood that although downward indentations are most preferred, indentations may also be formed upward from the top surface of the drumhead 2.

The indentations 10 can be preformed in the drumhead 2 by any method, however, most preferred is the use of mating embossing dies without the use of heat. The particular drumhead 2 is preferably placed between the mating dies which are then compressed to form the indentations 10. Alternatively, the polymer film material can be embossed prior to creation of the flange 6 and attachment to the hoop 8.

Variations of the present invention described herein will make themselves apparent to one skilled in the art. All such variations are intended to fall within the spirit and scope of the invention, limited solely by the appended claims. All patents referred to herein are incorporated by reference.

I claim:

1. A drumhead formed of a synthetic film material having overtone dampening means comprising a plurality of indentations preformed in the film material.

2. The drumhead of claim 1 wherein the synthetic film material is a polymer.

3. The drumhead of claim 1 wherein the synthetic film material is polyester.

4. The drumhead of claim 1 wherein the synthetic film material has a thickness of from about 0.007" to about 0.014".

5. The drumhead of claim 1 wherein the film material comprises two or more layers of a synthetic film sheet.

6. The drumhead of claim 5 wherein the indentations are formed in at least one layer of the film sheet.

7. The drumhead of claim 1 wherein the film material comprises a film sheet and a tone control ring of a synthetic film material.

8. The drumhead of claim 7 wherein the indentations are preformed on the tone control ring.

9. The drumhead of claim 1 wherein the indentations are preformed on the periphery of the center portion of the drumhead.

10. The drumhead of claim 1 wherein one or more indentations are circular, being from about 0.160 to about 0.168 inch in diameter and having a depth of from about 0.053 to about 0.072 inch.

* * * * *